US005794263A

United States Patent [19]

Carman

[11] Patent Number: 5,794,263

[45] Date of Patent: Aug. 18, 1998

[54] INSECT PROTECTIVE GARMENT

[76] Inventor: Nancy T. Carman, P.O. Box 190, 78 Whitney Brook Rd., Elkins, N.H. 03233

[21] Appl. No.: 840,598

[22] Filed: Apr. 22, 1997

[51] Int. Cl.[6] ..... A41D 13/00

[52] U.S. Cl. ..... 2/84; 2/4; 2/202; 2/424

[58] Field of Search ..... 2/4, 84, 202, 173, 2/424

[56] References Cited

U.S. PATENT DOCUMENTS

| | | | |
|---|---|---|---|
| 2,102,251 | 12/1937 | Arst | 2/84 |
| 5,091,993 | 3/1992 | Merrill et al. | 2/4 |
| 5,199,510 | 4/1993 | Schilling | 2/4 |
| 5,214,797 | 6/1993 | Tisdale | 2/84 |
| 5,357,635 | 10/1994 | Lemoine | 2/4 |

FOREIGN PATENT DOCUMENTS

| | | | |
|---|---|---|---|
| 1561459 | 2/1980 | United Kingdom | 2/84 |

*Primary Examiner*—Diana Biefeld

*Attorney, Agent, or Firm*—William B. Ritchie; Michael J. Persson

[57] ABSTRACT

An insect proof garment capable of being worn to fully or partially protect the head while fully protecting the torso and arms utilizing a zipper system running around the face cover where it joins the hood. The supportive effect of pleating the top of the face cover section and darting the hood top results in maximum protection and minimum visual interference, which is further minimized by use of a darker color fabric in the face cover than the rest of the garment. An integral pouch provides transport and storage of the garment plus a pocket when garment is worn.

20 Claims, 2 Drawing Sheets

INSECT PROTECTIVE GARMENT

BACKGROUND OF THE INVENTION

1. Field of the Invention

The invention relates to insect barriers which are worn.

2. Description of the Related Art

Various insects including but not limited to mosquitoes, gnats, ticks and chiggers are both a nuisance and a health risk to people who are outdoors. Numerous repellents have been used, most of which are inconvenient and in some cases dangerous. Many barrier garments exist in the prior art, all of which are inconvenient to gain access to the facial area for eating, drinking and other activities. In addition, the fit of many of these garments is poor, allowing the material to easily contact the skin of the wearer, thus increasing the risk of insect bites. As these garments are not required at all times, their transport and storage becomes a major issue both of convenience and of durability, as the light weight barrier fabrics tend to be somewhat fragile by their nature.

U.S. Pat. No. 4,979,236, issued to Merrill on Dec. 25, 1990 is representative of the genre of current insect protective garments. This device is a shirt comprising insect excluding mesh that has a head net attached to the upper body portion. The one piece head portion features a flap opening for access to the user's mouth and a triple tuck fold so as the head net will form a shape that will correspond to the user's head. The head portion is permanently attached to the upper body portion by stitching the head portion to the upper body portion.

U.S. Pat. No. 5,091,993, also issued to Merrill, discloses the same type of one piece head net, only in this embodiment, the head net can be partially detached from the upper body portion by a frontal zipper that extends from the front right shoulder seam to the left shoulder seam. The rear section of the head net is permanently stitched to the upper body portion as before.

U.S. Pat. No. 5,119,510, issued to Schilling on Jun. 9, 1992, discloses still another insect-proof garment. This device also features a one - piece hood that is permanently attached to the upper body portion of the garment. Schilling's hood is pleated at the back and pulls over the head in the same fashion as a hooded sweatshirt. To completely protect the user's face from insects, a purse string is provided around the front edge of the hood so that the hood can be completely closed. However, in this position, the gathering of the netting increases the thickness of material in front of the user's eyes which will substantially interfere with the user's vision. Moreover, once in the closed position, the hood cannot be easily opened to provide access to the user's mouth.

U.S. Pat. No. 4,685,152, issued to Heare on Aug. 11, 1987, discloses an insect protective garment with a yoke arrangement which serves to support the insectproof mesh that is attached to the yoke. The yoke is said to be lined with heavy cotton which makes the device unsuitable for warm conditions which is the time most insects are likely to be encountered. The manufacturing technique of using a series of puckers is very costly and extremely difficult to achieve uniformity from one unit to the next. The head net is a hood that is permanently attached to the garment. To provide access to the face, a removable face panel is provided that attaches via hook and loop fasteners being provided on the periphery. In order to make certain that insects will not be able to enter, extra material is provided on the face panel on the bottom which is said to be tucked in the upper body portion. This arrangement is difficult to attach and release. Further, if a user is not extremely careful, a portion of the face panel may be left open, inviting the entry of insects.

U.S. Pat. No. 4,422,184, issued to Myers on Dec. 27, 1983, discloses an insect protective garment that is similar to that of Heare. However, in this design, the face panel extends down to the upper body portion. Myers teaches that the entire periphery is to be preferably lined with hook and loop fastener so that the face panel can be releasably attached to the garment. In an alternative embodiment, the face panel includes a visor. This design suffers from the same problems as discussed above concerning the Heare disclosure.

Still another version of an insect protective garment is disclosed by Malin in U.S. Pat. No. 3,783,451, issued on Jan. 8, 1974. Malin discloses the use of circular rings to keep the netting material away from the user's skin and to encourage air flow.

There is not found in the prior art, an insect protective garment that provides No-SEEM-UM mesh netting in the area covering the face that is light gray in color; has a double-zipper opening over the head, from side to side, to easily control the size of the opening; has a hood that will easily accommodate a wide brim hat such as a cowboy hat; and has an integral zippered pocket which can be used to store the garment when not being used and can be used to carry small articles when the garment is being worn.

SUMMARY OF THE INVENTION

The invention is an insect protective garment for covering the head, arms and torso of a wearer. An upper body portion sized to correspond to the wearer's torso is provided. The upper body portion has a head opening sized such the wearer's head may easily pass therethrough, said upper body portion also has a torso opening sized such that the wearer's torso may easily pass therethrough. A pair of sleeves, permanently attached to said upper body portion, is provided. Said sleeves are sized such that the wearer's arms may easily be inserted therein. A hood which can completely enclose the wearer's head is provided. The hood is permanently attached to said upper body portion of the garment. The hood further has a front panel having a top, left and right sides and a bottom and a rear portion having a top, left and right sides and a bottom. The upper body portion and hood is formed from a single layer of semi-rigid insect excluding mesh. The mesh of said upper body portion and said rear portion of said hood is a color that is reflective of the radiant heat from the sun. The mesh of said front panel is a color that is substantially darker than said mesh used for the remaining garment such that greater visibility through said mesh of the front panel is provided.

It is an aspect of the invention to provide an insect protective garment that minimizes inconvenience to the wearer.

It is also an aspect of the invention to provide an insect protective garment that uses a fine mesh material that blocks the entry of even very small insects.

Another aspect of the invention is to provide an insect protective garment that uses a mesh that reflects a portion of the rays of the sun so that the garment is cooler to wear.

It is an aspect of the invention to provide an insect protective garment that provides a face panel that can be detached by a double zipper that permits the front face panel to be detached from the rear hood from side to side.

Another aspect of the invention is to provide an insect protective garment that has a plurality of folds, preferably four, to permit more room in front of a user's face.

Another aspect of the invention is to provide an insect protective garment that has a hood fashioned from two pieces of fine mesh of two different colors, with one piece providing a front face panel and with the other piece providing a rear portion.

It is an aspect of the invention to provide an insect protective garment that has a hood that is permanently attached to the upper body portion by stitching.

It is still another aspect of the invention to provide an insect protective garment that has a single dart in the rear portion with the dart centered and running fore and aft so as to provide sufficient room in the hood so that a large hat can be worn under the hood.

Another aspect of the invention is to provide an insect protective garment that has an integral pocket in the front of the upper body portion that can be used as carrying pouch when the garment is not being worn and can be used to carry small articles when the garment is being worn.

Another aspect of the invention is to provide an insect protective garment that has an integral pocket with a double pull zipper so that it can be used for two purposes.

It is an aspect of the invention to provide an insect protective garment that allows easy access to the face by a dual pull zipper at the edges of the face cover where it meets the hood of the garment so that it is accessible from either side or top, depending on where the user positions the zipper pulls.

Another aspect of the invention is to provide an insect protective garment that increases the user's comfort when wearing the garment by having all raw edges of all seams stitched to avoid skin irritation.

It is an aspect of the invention to provide an insect protective garment that has a face panel constructed of a single piece of material without the need for gathers, zippers or other interferences in front of the user's face that might impair visibility.

It is still another aspect of the invention to provide an insect protective garment that has integral pocket that has a loop so that the garment, when stored in its pocket, can be carried by attaching the loop to the user's belt, backpack, etc.

Finally, it is still another aspect of the invention to provide an insect protective garment that uses two different colors of mesh, a white or very pale colored mesh for constructing the bulk of the garment so that the sun's rays are reflected and a darker colored mesh for the section of the garment in front of the face so that visibility is improved.

Other aspects and advantages of the present invention will become apparent and obvious from a study of the following description and the accompanying drawings which are merely illustrative of the invention

DETAILED DESCRIPTION OF THE INVENTION

Figure 1:
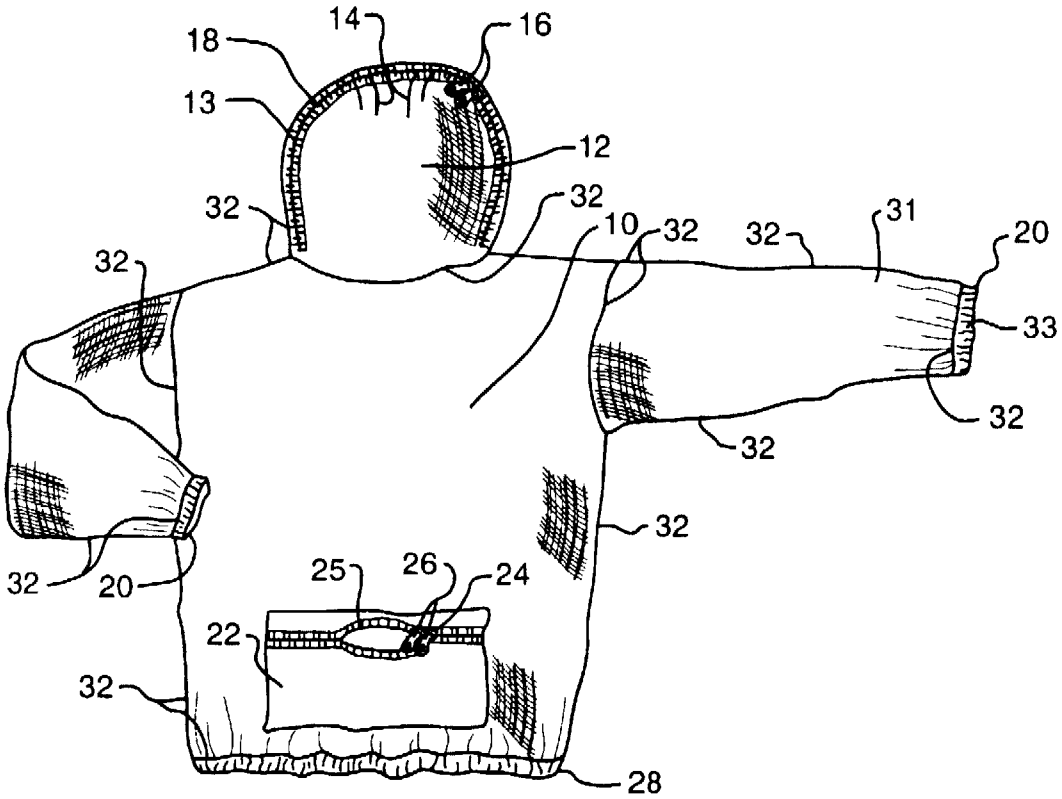
FIG. 1 is a frontal view of the preferred embodiment of the insect

Referring to FIG. 1, the preferred embodiment of invention 10 is shown, the entire garment being made of sufficiently fine mesh to exclude small insects such as gnats, chiggers, and the like. Preferably, the mesh used to form invention 10 is NO-SEE-UM mesh that is manufactured by T. W. Textiles of Seattle, Wash. or any mesh having similar properties. Material for garment 10 is of light color to minimize heat absorption except for the face cover 12 which is of a darker, more optically transparent color. The preferable color for most of invention 10 is white, while the color for face cover 12 is preferable dark grey. The face cover 12 is secured to the rear portion 31 hood 13 of the garment by means of a zipper track 18 which runs continuously along the joint between the face cover 12 and dthe rear portion 31 of hood 13, zipper track 18 being fitted with two zipper sliders 16 with each slider having its own pull to enable the wearer to open the face cover 12 from any point on the zipper track 18. The face cover 12 is shaped in part by a series of pleats 14 which tend to stiffen the fabric to enable it to remain separated from the face of the wearer. While the number of pleats 14 is preferably 4, any number of pleats that accomplish the same task would be also be acceptable.

Figure 2:
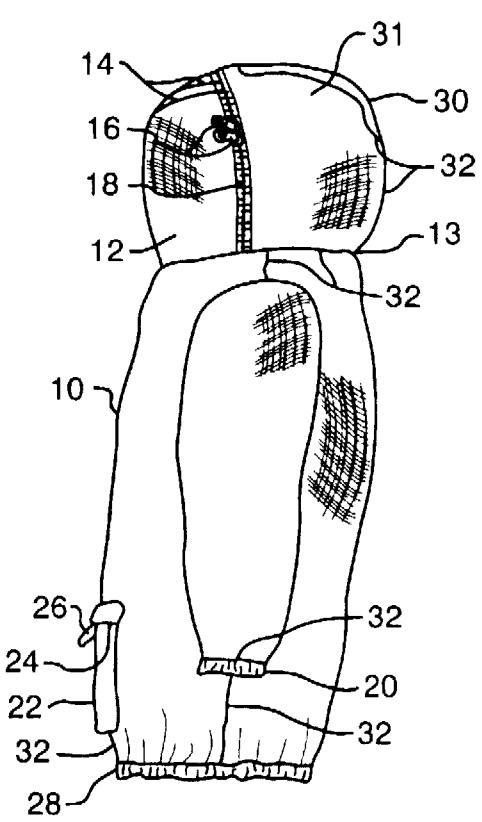
FIG. 2 is a side view.
Figure 5:
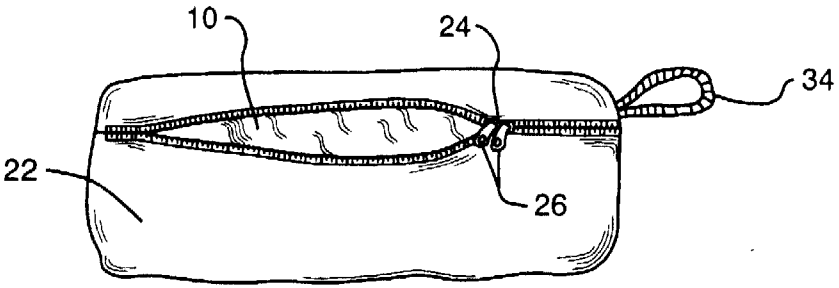
FIG. 5 is a detail of the invention folded into its pouch, viewed from the front.

The arms 31 terminate at cuffs 33 fitted with elastic type material 20 to prohibit the entry of insects to the garment, as is the garment's waist 28. The garment is fitted with a reversible pouch 22 secured to the outer surface of the invention 10, which is shown in the lower front torso area of the invention 10. However, pouch may be positioned in other locations on the garment with equal effect. The reversible nature of the pouch 22 is accomplished by a zipper track 25 and zipper slider 24 equipped with two pulls 26, one on either side of the zipper track 25 and slider 24. This closure method may, however, be accomplished with other closure systems such as, but not limited to, hook and loop type fastener tape, capable of functioning with pouch 22 in either standard or reversed mode; standard mode being as illustrated in FIGS. 1 and 2; reversed mode as illustrated in FIG. 5. All seams of the invention 10 are made more comfortable against the skin of the wearer by utilizing sewing stitches which provide a loop of thread over the material joint for every stitch 32, thus shielding the skin of the wearer from direct contact with the raw edge of the fabric used in the garment 10, this component of the stitch commercially known as serging or overcasting.

FIG. 2, a side view of the invention 10, shows the dart 30 built into the top of the hood 13 of invention 10. Also, evident in FIG. 2 are the pleats 14 in the face cover 12, the zipper track 18 securing the face cover 12 to the hood 13 and the two zipper sliders 16.

Figure 4:
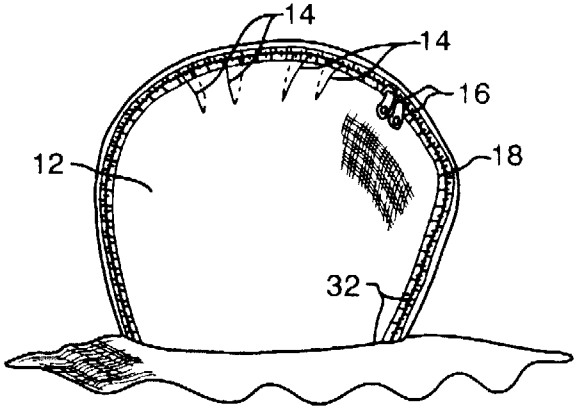
FIG. 4 is a detail of the pleats in the face cover, viewed from the front.
Figure 3:
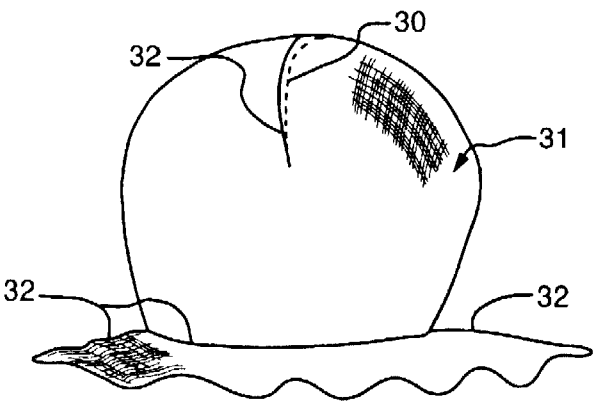
FIG. 3 is a detail of the dart in the top of the hood, viewed from the rear.

FIG. 3 shows a rear view of the the rear portion 31 of the garment's hood 13 and dart 30 which serves to shape the hood 13 and assist in keeping the fabric away from the wearer's head. FIG. 4 represents a front view of the face cover 12 and the preferred embodiment of supporting pleats 14 of which four are shown and , as noted above, the amount and orientation being variable to suit different sizes and fabrics as required. FIG. 5 shows invention 10 packed into its built -in pouch 22 with the zipper 24 partially closed to allow illustration of the pulls 26 placed to be accessible from both sides of the track. A preferred, though not essential feature of the pouch 22, when in reversed mode (FIG. 5), is a hanging loop to enable the packed garment to be hung from a belt or other convenient area.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. An insect protective garment for covering the head, arms and torso of a wearer, said garment comprising:

an upper body portion sized to correspond to a wearer's torso, said upper body portion having a head opening sized such wearer's head may easily pass therethrough, said upper body portion also having a torso opening sized such that a wearer's torso may easily pass therethrough;

a pair of sleeves, permanently attached to said upper body portion, said sleeves sized such that a wearer's arms may easily be inserted therein; and a hood which can completely enclose a wearer's head, said hood being permanently attached to said upper body portion;

wherein said hood comprises a face cover having a top, left and right sides and a bottom and a rear portion having a top, left and right sides and a bottom, and wherein said face cover further comprises a plurality of trianaular shaped folds adjacent to the top of said face cover; and wherein said upper body portion and said rear portion of said hood are formed from a single layer of semi-rigid insect excluding mesh; said mesh of said upper body portion and said rear portion of said hood being a color that is reflective of radiant heat from the sun and said mesh of said face cover being a color that is substantially darker than said mesh used for the remaining garment such that greater visibility through said mesh of said front panel is provided.

2. The insect protective garment of claim 1 wherein said rear portion further comprises a dart extending from the top of said rear portion toward the bottom, substantially equidistant between the left and right sides of said rear portion.

3. The insect protective garment of claim 1 wherein the left and right sides and said top of said face cover are releasably attached, respectively to the left, right sides and top of said rear portion.

4. The insect protective garment of claim 3 wherein said face cover is releasably attached to said rear portion via a zipper.

5. The insect protective garment of claim 4 wherein said zipper comprises two zipper sliders with each zipper slider having its own zipper pull.

6. The insect protective garment of claim 1 further comprising:

a reversible pouch attached to said upper body portion such that said garment can be folded into said pouch for storage when said garment is not being worn.

7. The insect protective garment of claim 6 wherein said pouch has zipper with a slider having two pulls, one on either side of the slider so that said pouch can be closed from either side of said pouch.

8. The insect protective garment of claim 6 wherein said pouch further comprises a loop so that said pouch with said garment folded therein can be carried by said loop.

9. The insect protective garment of claim 1 wherein each of said sleeves further comprises elasticized cuffs so that said sleeves will be securely fastened about a wearer's wrists to prevent the entry of insects.

10. The insect protective garment of claim 1 wherein said torso opening is fitted with an elasticized band such that said upper body portion may be securely fastened about the wearer's torso to prevent the entry of insects.

11. An insect protective garment for covering the head, arms and torso of a wearer, said garment comprising:

an upper body portion sized to correspond to a wearer's torso, said upper body portion having a head opening sized such a wearer's head may easily pass therethrough, said upper body portion also having a torso opening sized such that a wearer's torso may easily pass therethrough;

a pair of sleeves, permanently attached to said upper body portion, said sleeves sized such that a wearer's arms may easily be inserted therein; and a hood which can completely enclose the wearer's head, said hood being permanently attached to said upper body portion;

wherein said hood comprises a face cover and a rear portion, each having a top, left and right sides and a bottom, said rear portion further comprising a dart extending from the top of said rear portion toward the bottom, substantially equidistant between the left and right sides of said rear portion; and wherein said upper body portion and said rear portion of said hood are formed from a single layer of semi-rigid insect excluding mesh having a color that is reflective of radiant heat from the sun, and wherein said face cover is formed from a layer of semi-rigid insect excluding mesh having a color that is substantially darker than said mesh of said upper body portion and said rear portion of said hood such that greater visibility through said mesh of said face cover is provided.

12. The insect protective garment of claim 11 wherein said face cover is releasably attached to said rear portion via a zipper.

13. The insect protective garment of claim 12 wherein said zipper further comprises two zipper sliders with each zipper slider having a corresponding zipper pull.

14. The insect protective garment of claim 11 further comprising a reversible pouch attached to said upper body portion such that said garment can be folded into said pouch for storage when said garment is not being worn.

15. The insect protective garment of claim 14, wherein said pouch comprises a zipper with a slider having two ends and a pull disposed at each end such that said pouch may be closed from either end of said pouch.

16. The insect protective garment of claim 11 wherein each of said sleeves further comprises elasticized cuffs so that said sleeves will be securely fastened about a wearer's wrists and wherein said torso opening is fitted with an elasticized band such that insects are prevented from entering through said sleeves and said torso opening.

17. An insect protective garment for covering the head, arms and torso of a wearer, said garment comprising:

an upper body portion sized to correspond to a wearer's torso, said upper body portion having a head opening sized such a wearer's head may easily pass therethrough, said upper body portion also having a torso opening sized such that a wearer's torso may easily pass therethrough;

a pair of sleeves, permanently attached to said upper body portion, said sleeves sized such that a wearer's arms may easily be inserted therein; and a hood which can completely enclose a wearer's head, said hood being permanently attached to said upper body portion;

wherein said hood comprises a face cover and a rear portion, each having a top, left and right sides and a bottom;

wherein said face cover is releasably attached to said rear portion via a zipper, said zipper comprising two zipper sliders with each zipper slider having its own zipper pull, and wherein said upper body portion and said rear portion of said hood are formed from a single layer of semi-rigid insect excluding mesh having a color that is reflective of radiant heat from the sun, and wherein said face cover is formed from another layer of semi-rigid insect excluding mesh, having a color that is substantially darker than said mesh of said upper body portion and said rear portion of said hood, such that greater visibility through said mesh of said face cover is provided.

18. The insect protective garment of claim 17 further comprising:

a reversible pouch attached to said upper body portion such that said garment can be folded into said pouch for storage when said garment is not being worn.

19. The insect protective garment of claim 18, wherein said pouch comprises a zipper with a slider having two ends and a pull disposed at each end such that said pouch may be closed from either end of said pouch.

20. The insect protective garment of claim 17 wherein each of said sleeves further comprises elasticized cuffs so that said sleeves will be securely fastened about a wearer's wrists and wherein said torso opening is fitted with an elasticized band such that insects are prevented from entering through said sleeves and said torso opening.

* * * * *